United States Patent [19]

Collins

[11] Patent Number: 4,879,823

[45] Date of Patent: Nov. 14, 1989

[54] DECORATIVE MESSAGE DISPLAY

[76] Inventor: Dane H. Collins, 5242 N. 24th St., Phoenix, Ariz. 85016

[21] Appl. No.: 202,325

[22] Filed: Jun. 6, 1988

[51] Int. Cl.[4] ..... G09F 1/00

[52] U.S. Cl. ..... 40/124.1; 40/539; 446/222

[58] Field of Search ..... 40/124.1, 539, 214; 446/222, 220; 211/60.1, 70.1; 248/450, 459

[56] References Cited

U.S. PATENT DOCUMENTS

| | | | |
|---|---|---|---|
| 1,742,854 | 1/1930 | Ferguson | 248/450 |
| 2,497,657 | 2/1950 | Cole | 40/124.1 |
| 3,250,241 | 5/1966 | Levy et al. | 446/220 |
| 4,062,138 | 12/1977 | Warenbeck | 40/124.1 |
| 4,310,095 | 1/1982 | Fontlladosa | 211/70.1 |
| 4,661,081 | 4/1987 | Basseches | 446/222 |

FOREIGN PATENT DOCUMENTS

| | | | |
|---|---|---|---|
| 321798 | 11/1929 | United Kingdom | 40/539 |
| 376012 | 7/1932 | United Kingdom | 40/124.1 |
| 376052 | 7/1932 | United Kingdom | 40/539 |

*Primary Examiner*—Robert P. Swiatek
*Assistant Examiner*—Cary E. Stone
*Attorney, Agent, or Firm*—Don J. Flickinger; Jordan M. Meschkow; Lowell W. Gresham

[57] ABSTRACT

A display apparatus includes a front panel which may be punched from a perforated sheet of foam material such as polystyrene. The front panel contains an image area and a message area which may be preprinted or left blank and filled in by the user. The front panel is maintained in an upright position by coupling the lower edge of the front panel to the horizontal base. A plurality of balloons are coupled to first ends of a plurality of rods. The other ends of the rods are inserted into the foam material of the front panel to complete the structure.

22 Claims, 2 Drawing Sheets

DECORATIVE MESSAGE DISPLAY

BACKGROUND OF THE INVENTION

This invention relates generally to greeting cards and, more particularly, to a free-standing message display including balloons and/or other decorative appendages and a kit for the assembly thereof.

The use of preprinted greeting cards has become widespread. As a matter of fact, it has become so common that very often times the recipient of a greeting card pays only casual attention to it, and the card is usually promptly discarded.

Recently, the sale of helium-filled balloon bouquets have become very common for the purpose of conveying messages of good cheer. Unfortunately, helium-filled balloons tend to deflate after six to eight hours, and therefore may be ineffective mechanisms for the transmission of long term messages.

SUMMARY OF THE INVENTION

It is an object of the present invention to provide a unique display apparatus which may be utilized to express messages.

It is a further object of the present invention to provide a kit which may be easily assembled to provide a unique display apparatus which will convey either a preprinted or personalized message.

According to a broad aspect of the invention there is provided a message display apparatus which comprises a front panel containing a preprinted or blank image portion and either a preprinted or blank message area. If blank, the user may write or print a desired message. A base is provided to which the front panel may be clipped or otherwise attached so as to support the front panel in an upright position. A plurality of balloons may be inflated and attached to the first ends of a plurality of rods, the second ends of which are secured to the front panel. The front panel and base are preferably made of a foam material such as polystyrene which allows for easy insertion of the free ends of the balloon bearing rods. The front panel may be punched from a pre-cut or perforated sheet of foam material. A second portion of the sheet may be utilized as the base. In an alternately preferred embodiment, the front panel and the base are integrally formed of a rigid plastic material, such as acetate. Sockets are formed in the front panel for receiving the free ends of the balloon bearing rods.

When provided in kit form, there is provided a sheet of foam material in which the front panel is cut or perforated. The base may form a portion of the sheet of foam material. Also provided are a plurality of balloons, rods to which the balloons may be secured, and clips for attaching the base to the front panel. A permanent marker may also be included for writing or printing a custom message in the message area of the front panel.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
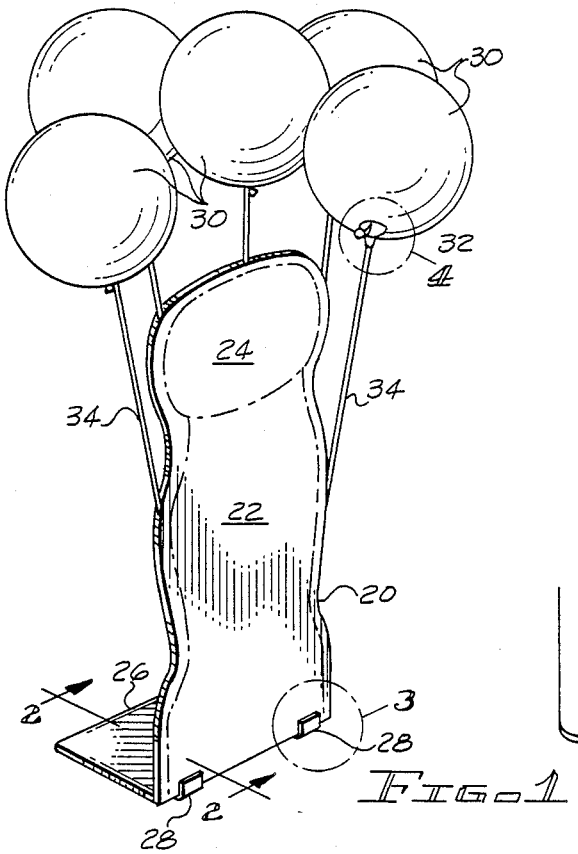
FIG. 1 is an isometric view of the inventive message display apparatus in assembled form.

FIG. 1 illustrates the inventive message display apparatus. As can be seen, the apparatus includes a front panel 20 having a desired shape and including an image area 22 and a message area 24. Either one or both of image area 22 and message area 24 may be preprinted or left blank so as to permit the sender to customize front panel 20 with his own message and/or image. Alternately, a message and image may be produced on the front surface of front panel 20 by, for example, printing, labeling, silk-screening, etc.

A base 26 is provided which when coupled along an edge thereof to the lower edge of front panel 20 as for example by clips 28, front panel 20 will be held in an upright position. Front panel 20 and base 26 are made of a foam material such as polystyrene and has a thickness of, for example, three-eights of an inch.

A plurality of inflated balloons 30 are each coupled to a plastic balloon cup 32 which is in turn fixed on a first end of a rod 34. Rods 34 may be made of wood, acrylic, plastic, etc., and preferably have a diameter of approximately one-eight of an inch. The second or free end of rods 34 are easily inserted into the foam material of front panel 20.

Figure 2:
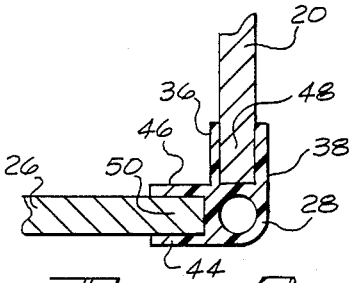
FIG. 2 is a cross-sectional view taken along the line 2—2 in FIG. 1 and illustrates how the base and front panel are clipped together to support the front panel in an upright position.
Figure 3:
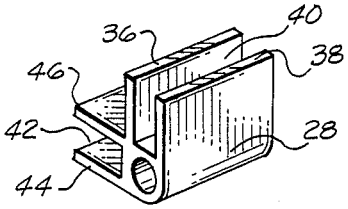
FIG. 3 is an isometric view of a clip which may be utilized to couple the base and front panel together.

FIGS. 2 and 3 illustrate in more detail clip 28 used for coupling base 26 to front panel 20. As can be seen, clip 28 is comprised of first and second substantially upright and parallel walls 36 and 38 forming a slot 40 therebetween. In a like manner, a generally horizontal slot 42 is formed by horizontal and rearward extending parallel walls 44 and 46. The lower edge 48 of front panel 20 is then inserted into slot 40 while the leading edge 50 of base 26 is inserted into slot 42. In this manner, the stability of base 26 is imparted to front panel 20 so as to maintain it in an upright position.

Figure 4:
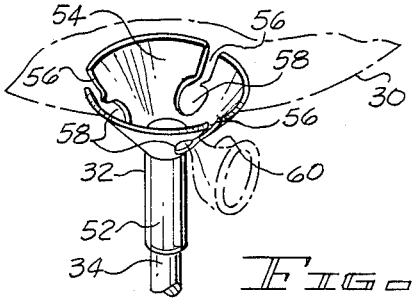
FIG. 4 illustrates a balloon cup to which an inflated balloon may be attached.

FIG. 4 illustrates in more detail the plastic balloon cups 32 shown in FIG. 1. As can be seen, each cup includes a hollow stem portion 52 for positioning on the upper end of rod 34. A funnel-shaped upper portion 54 is fixedly coupled to stem 52 and includes a plurality of slots 56 therein each of which terminates with a rounded portion 58. After balloon 30 (shown dotted in FIG. 4) is inflated, its neck portion 60 is brought down through one of the slots 56 and comes to reside in one of the rounded portions 58. Slot 56 and rounded portion 58 are sized so as to maintain neck 60 in a compressed constricted manner thus preventing air from escaping from the balloon. Thus, the inventive display apparatus has an extended life and is much more likely to be utilized for longer periods of time than mere greeting cards or helium-filled balloon bouquets.

Preferably, the image portion of front panel 20 may be approximately twenty-seven inches in width and forty inches in height. Balloons 30 may have printing or other images on their surface and may even be jeweled. It should also be noted that holes may be dye cut in front panel 20 to provide for easy insertion of the free end of rods 34 as is shown in connection with a further embodiment of the invention.

Figure 5:
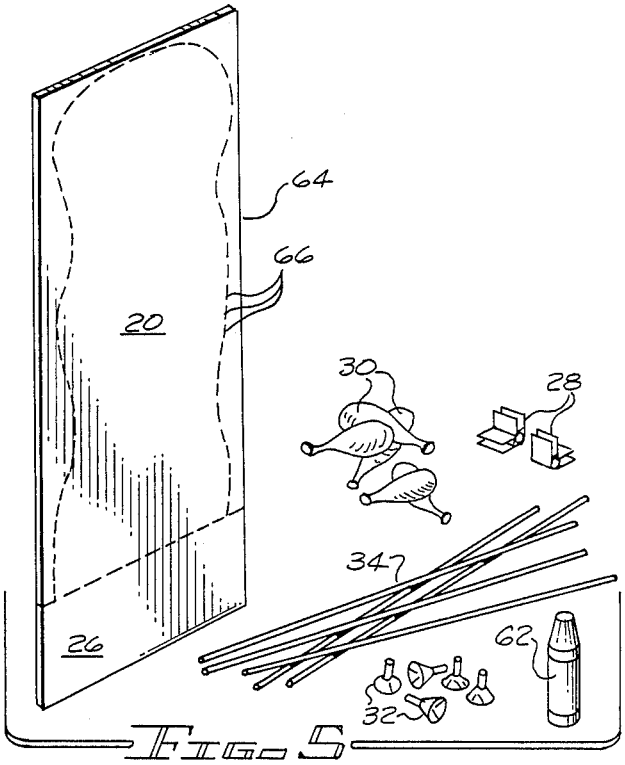
FIG. 5 illustrates the inventive message display apparatus in kit form.

The inventive display apparatus shown in FIG. 1 may be provided in kit form as is shown in FIG. 5. That is, the kit would include a plurality of balloons 30, first and second clips 28, a plurality of rods 34, a plurality of balloon cups 32 and a marker 62 for producing a message on the message area 24 of front panel 20. The kit would also include a rectangular piece of foam material 64 having a thickness of approximately three-eights of an inch. Perforations 66 having been dye cut into foam material 64 correspond in outline to front panel 20. The bottom portion of rectangular sheet 64 corresponds to base 26.

Figure 6:
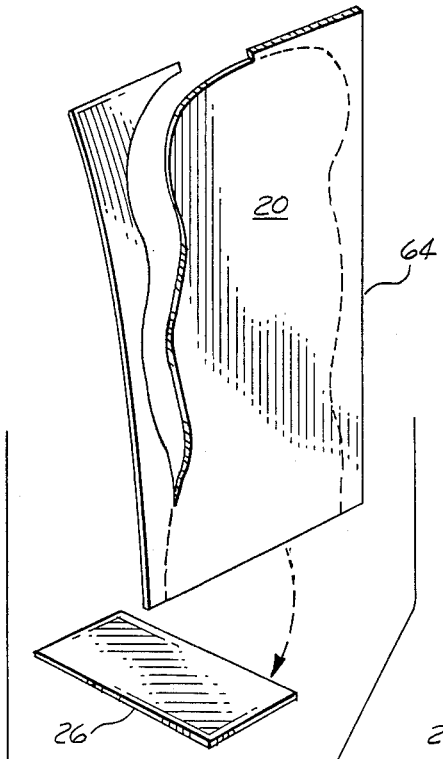
FIGS. 6, 7 and 8 illustrate the inventive message display apparatus in various stages of assembly.
Figure 7:
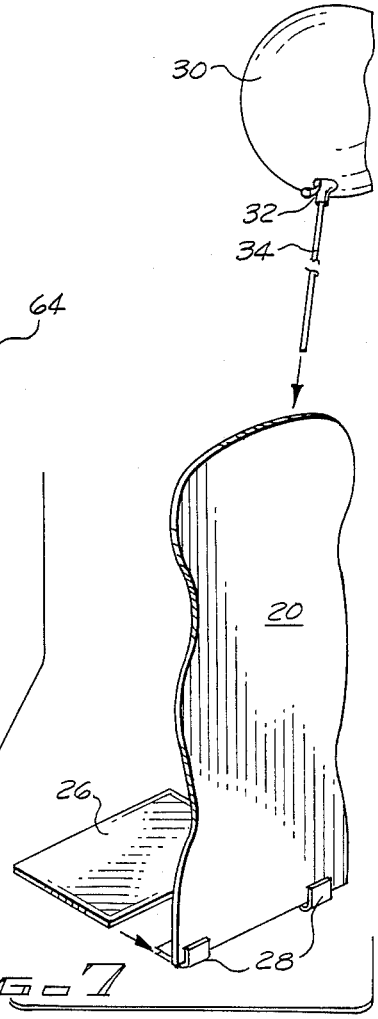

To assemble the inventive display apparatus, base 26 is first separated from the remainder of rectangular sheet 64, and front panel 20 is punched out as is shown in FIG. 6. Base 26 is then attached to front panel 20 by means of clips 28 so as to support front panel 20 in an upright position. Balloons 30 are inflated and attached to rods 34 by means of cups 32, and rod 34 is inserted into front panel 20 as is shown in FIG. 7.

Figure 11:
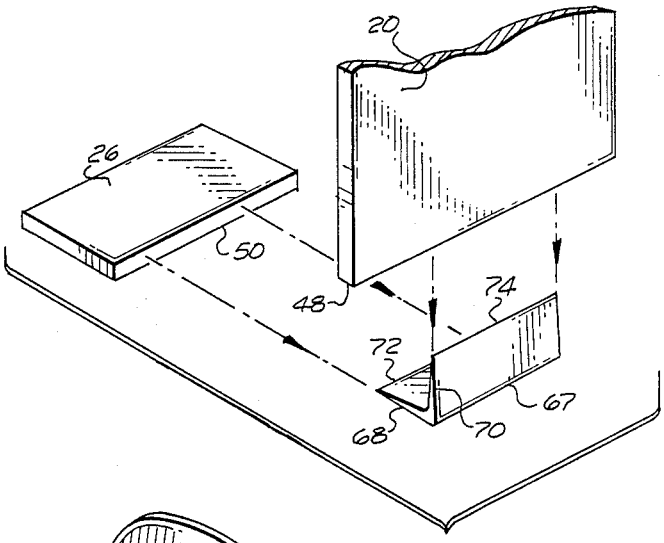
FIG. 11 illustrates an alternative technique for coupling the base and front panels so as to support the front panel in an upright position.

FIG. 11 illustrates an alternative form of clip 66 which may be used to couple base 26 to front panel 20. As can be seen, clip 66 comprises an angle bracket having first and second legs 68 and 70 each of which has a sharp edge 72 and 74, respectively. Leg 68 is caused to penetrate leading edge 50 of base 26 while leg 70 is caused to penetrate the bottom edge 48 of front panel 20.

Figure 8:
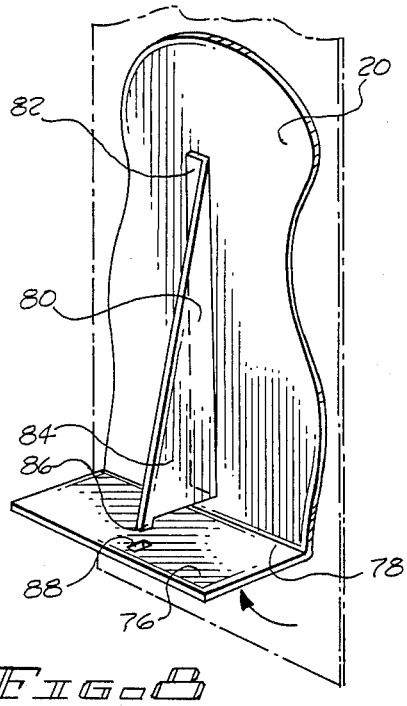

FIG. 8 illustrates yet an additional approach to maintaining front panel 20 in an upright position. In this case, a base portion 76 is integral with front panel 20 however folded at right angles with respect thereto along line 78. An easel member 80 is fixedly coupled as for example by gluing along a section 82 thereof to the back surface of front panel 20. An outwardly extending portion 84 is provided at its lower outer end with a protrusion 86 which may be matingly received within aperture 88 in base 76.

Figure 9:
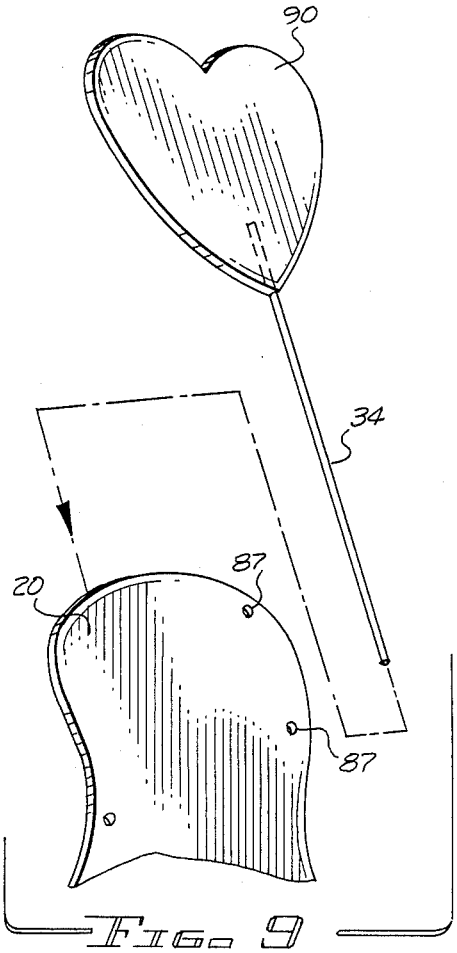
FIG. 9 illustrates alternate arrangements for securing an inflated balloon to an end of the rods.

Referring now to FIG. 9, it can be shown that other forms of decorative cut-outs such as hearts 90 also made, for example, from a foam material such as polystyrene, may be fixed to one end of rod 34 while the other end of rod 34 penetrates the edge of front panel 20. As alluded to previously, holes 87 may be provided in front panel 20 into which the free end of rods 34 are inserted.

Figure 10:
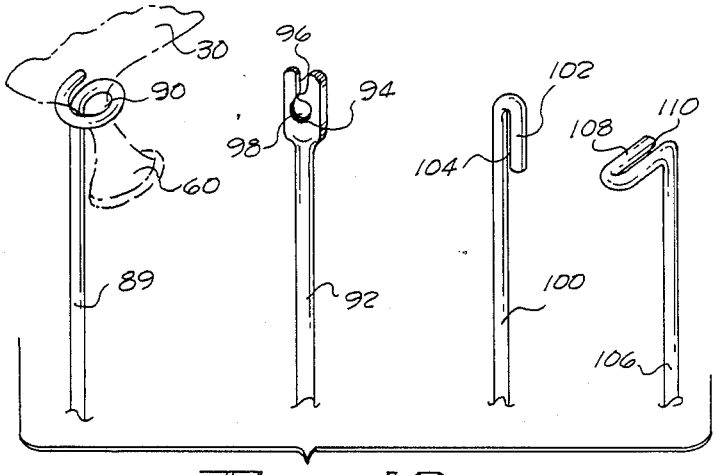
FIG. 10 illustrates the use of alternate decorative cut-outs in place of balloons.

FIG. 10 illustrates that the rods 34 may be terminated in such a manner so as to avoid the necessity for balloon cups 32. For example, rod 90 has an upper coil portion 90 which receives and constricts neck 60 of balloon 30 so as to prevent air from escaping therefrom. Rod 92 is provided with a flattened end portion 94 having a slot 96 therein which terminates with a rounded portion 98. This arrangement functions as did the slots 56 and rounded portions 58 in balloon cups 32 as shown and described in connection with FIG. 4. Rod 100 is bent back on itself such as is shown at 102 so as to form a slot 104. The neck of the balloon is then pulled into slot 104 which constricts it sufficiently so as to prevent air from escaping from the balloon. Finally, rod 106 has coupled to its end a U-shaped member 108 which extends substantially perpendicularly from rod 106. The U-shaped member 108 forms a slot 110 into which the neck of the balloon may be urged.

Figure 12:
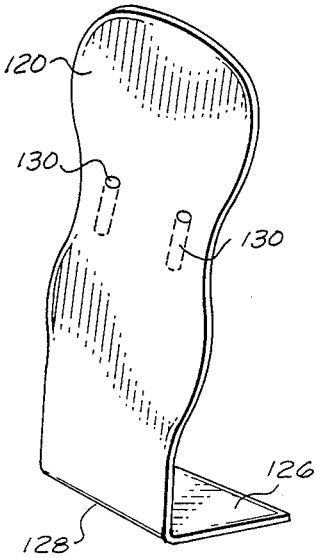
FIG. 12 illustrates an alternately preferred display apparatus in which the base and front panel are integrally formed of a rigid material.

It is within the scope of the instant invention that the front panel and the base are integrally formed of a rigid material, such as acrylic. With reference to FIG. 12 there is seen such an embodiment including front panel 120 and base 126 which are joined along fold 128. Sockets 130 formed into front panel 120 receive the lower ends of the rods 34.

The above description is given by way of example only. Changes in form and detail may be made by one skilled in the art without departing from the scope of the invention as defined by the appended claims.

I claim:

1. A display apparatus, comprising:

a front panel having a message area and an image area;

a base for maintaining said front panel in an upright position;

a plurality of rods each having first and second ends;

a plurality of decorative means, each of said decorative means being an inflated balloon having a neck portion, each coupled to the first ends of one of said plurality of rods, the second end of each of said plurality of rods being inserted into said front panel; and at least one clip for coupling said base to said front panel.

2. An apparatus according to claim 1, wherein said at least one clip is provided with first and second substantially perpendicular channels, said first channel for receiving a leading edge of said base and said second channel for receiving a lower edge of said panel.

3. The apparatus according to claim 1, wherein said front panel is of a foam material.

4. An apparatus according to claim 3, wherein said foam material is polystyrene.

5. An apparatus according to claim 1, wherein said base is made of a foam material and wherein said at least one clip is an angle bracket having first and second substantially perpendicular legs each having a sharpened edge, the sharpened edge of said first leg for penetrating into a leading edge of said base and the sharpened edge of said second leg for penetrating into the lower edge of said front panel.

6. An apparatus according to claim 1, further comprising a plurality of apertures in said front panel for receiving therethrough the second end of said rods.

7. An apparatus according to claim 1, wherein each of said plurality of rods is acrylic.

8. An apparatus according to claim 1, wherein each of said rods is wood.

9. A display kit, comprising:

a rectangular sheet of foam material having a plurality of perforations therein corresponding to the outline of a front panel, said front panel having an image area and a message area;

a base;

first means for coupling a leading edge of said base to a lower edge of said panel so as to support said panel in an upright position;

a plurality of rods each having first and second ends; and a plurality of decorative means, each for coupling to the first end of one of said plurality of rods, the second end of each of said plurality of rods to be inserted into said front panel.

10. A kit according to claim 9, further comprising writing means for writing a message on said message area.

11. A kit according to claim 10, wherein said writing means is a permanent marker.

12. A kit according to claim 9, wherein said base comprises a portion of said sheet which may be separated therefrom along a plurality of pre-cut perforations.

13. A kit according to claim 9, wherein said message area is pre-printed.

14. A kit according to claim 9, wherein said message area is blank.

15. A kit according to claim 9, further comprising second means for attaching said decorative means after inflation to said rod.

16. A kit according to claim 15, wherein the first end of each of said plurality of rods is configured so as to receive and compress the neck portion of one of said plurality of balloons after inflation.

17. A kit according to claim 15, wherein said second means is a balloon cup comprising:

a cylindrical portion for receiving a first end of one of said plurality of rods; and a cone-shaped member having at least one stalk therein for receiving and compressing a neck portion of said balloon, said cone-shaped member being attached to said cylindrical portion.

18. A kit according to claim 9, wherein said first means comprises at least one clip provided with first and second substantially perpendicular channels, said first channel for receiving a leading edge of said base and said second channel for receiving a lower edge of said front panel.

19. A kit according to claim 9, wherein said base is made of said foam material and wherein said first means comprises at least one clip in the form of an angle bracket having first and second substantially perpendicular legs each having a sharpened edge, the sharpened edge of said first leg for penetrating into a leading edge of said base and the sharpened edge of said second leg for penetrating into a lower edge of said front panel.

20. A kit according to claim 9, further comprising a plurality of apertures in said front panel for receiving therethrough the second end of said rods.

21. A kit according to claim 9, wherein each of said plurality of rods is acrylic.

22. A kit according to claim 9, wherein said foam material is polystyrene.

* * * * *